US008225857B2

(12) United States Patent
Yadav et al.

(10) Patent No.: US 8,225,857 B2
(45) Date of Patent: Jul. 24, 2012

(54) BREECH LOCK MECHANISMS FOR BLOWOUT PREVENTER AND METHOD

(75) Inventors: Seemant Yadav, Houston, TX (US); Robert Judge, Houston, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 316 days.

(21) Appl. No.: 12/625,812

(22) Filed: Nov. 25, 2009

(65) Prior Publication Data

US 2011/0120699 A1 May 26, 2011

(51) Int. Cl.
*E21B 33/06* (2006.01)

(52) U.S. Cl. ..... 166/85.4; 137/15.18

(58) Field of Classification Search ..... 166/85.4; 137/15.18; 251/1.1, 1.3
See application file for complete search history.

(56) References Cited

U.S. PATENT DOCUMENTS

| | | | | | |
|---|---|---|---|---|---|
| 4,102,473 | A | | 7/1978 | Draxler | |
| 4,558,842 | A | * | 12/1985 | Peil et al. | 251/1.3 |
| 5,279,365 | A | | 1/1994 | Yenulis et al. | |
| 5,287,879 | A | * | 2/1994 | Leggett et al. | 137/246.22 |
| 5,433,490 | A | | 7/1995 | Hurd et al. | |
| 5,897,094 | A | | 4/1999 | Brugman et al. | |
| 5,975,484 | A | | 11/1999 | Brugman et al. | |
| 6,457,484 | B1 | * | 10/2002 | Najmolhoda | 137/15.18 |
| 6,510,897 | B2 | | 1/2003 | Hemphill | |
| 6,554,247 | B2 | | 4/2003 | Berckenhoff et al. | |
| 6,845,959 | B2 | | 1/2005 | Berckenhoff et al. | |
| 7,051,989 | B2 | * | 5/2006 | Springett et al. | 251/1.1 |
| 7,051,990 | B2 | | 5/2006 | Springett et al. | |
| 7,281,586 | B2 | | 10/2007 | Hemphill et al. | |
| 7,331,562 | B2 | | 2/2008 | Springett | |
| 7,380,590 | B2 | | 6/2008 | Hughes et al. | |
| 7,413,019 | B2 | | 8/2008 | Hemphill et al. | |
| 8,028,755 | B2 | * | 10/2011 | Darnell et al. | 166/379 |
| 2003/0085040 | A1 | | 5/2003 | Hemphill et al. | |
| 2006/0000992 | A1 | * | 1/2006 | Springett et al. | 251/1.3 |
| 2007/0246215 | A1 | * | 10/2007 | Springett et al. | 166/298 |
| 2008/0142746 | A1 | | 6/2008 | Hemphill et al. | |
| 2008/0258463 | A1 | | 10/2008 | Horikawa et al. | |

OTHER PUBLICATIONS

Search Report and Written Opinion from corresponding PCT Application No. PCT/US2010/053038 dated Jun. 3, 2011.

* cited by examiner

*Primary Examiner* — William P Neuder
(74) *Attorney, Agent, or Firm* — Potomac Patent Group PLLC

(57) ABSTRACT

A blowout preventer for sealing a well includes a body having first and second chambers, the body including a channel on a face of the body; a ram block configured to move within the first chamber to seal a first region of the second chamber from a second region of the second chamber; a rod connected to the ram block and configured to extend along the first chamber; a cylinder configured to be attached to the body to border the first chamber, and a ring rotatably attached to the cylinder for attaching the cylinder to the body.

20 Claims, 9 Drawing Sheets

BREECH LOCK MECHANISMS FOR BLOWOUT PREVENTER AND METHOD

BACKGROUND

1. Technical Field

Embodiments of the subject matter disclosed herein generally relate to methods and systems and, more particularly, to mechanisms and techniques for attaching parts to a body of a ram blowout preventer.

2. Discussion of the Background

During the past years, with the increase in price of fossil fuels, the interest in developing new production fields has increased dramatically. However, the availability of land-based production fields is limited. Thus, the industry has now extended drilling to offshore locations, which appear to hold a vast amount of fossil fuels.

The existing technologies for extracting fossil fuels from offshore fields use, among other things, a blowout preventer (BOP) for preventing well blowouts. The BOP is conventionally implemented as a valve to prevent the release of pressure either in the annular space between the casing and the drill pipe or in the open hole (i.e., hole with no drill pipe) during drilling or completion operations. However, various components of the BOP need to be replaced from time to time. An example of a BOP 20 is shown in FIG. 1. The BOP 20 shown in FIG. 1 has, among other things, two ram blocks 22 that are supported by respective piston rods 24 and a corresponding locking mechanism 26. The locking mechanism 26 is configured to lock the rods 24 at desired positions. The two ram blocks 22 are configured to move along a direction parallel to a longitudinal axis of the piston rods 24. The ram blocks 22 may sever a drill string 28 or other tools that cross a vertical wellbore 30 of the BOP 20. However, after cutting the drill string 28 for a number of times, the ram blocks 22 and/or their respective cutting edges need to be inspected and sometimes reworked/replaced. Alternatively, if the ram blocks 22 are designed to seal the well and not to cut a tool, an elastomer provided on a face of the ram blocks 22 needs to be replaced after a certain number of closures of the BOP. For this reason, the BOP 20 of FIG. 1 is provided with a bonnet 32, for each ram block 22, which, for a particular BOP design, can be opened for providing access to the ram blocks. FIG. 2 shows the bonnet 32 having a hinge 34 that rotatably opens the bonnet 32.

However, those skilled in the art would recognize that regular service of the BOP is required for changing the blades and/or elastomer attached to the ram blocks. Thus, the BOP bonnets frequently need to be separated from the BOP body to expose and service the ram block. The operation of separating the bonnets from the BOP body is no easy task, and frequently requires special tooling sized to accommodate the large diameter bolts. Such an operation may require several eight-hour shifts of skilled technicians. However, the concern is the amount of down time for the entire rig, which cannot function without the BOP, as millions of dollars of drilling equipment may be idle during the BOP service operation.

A solution to this problem is to design BOPs with bonnetless "doors." However, these designs have other undesirable features. One design utilizes a removable bar (see Brugman et al. U.S. Pat. No. 5,975,484, the entire disclosure of which is incorporated herein by reference), that must be handled and stored when accessing the ram cavity, which can lead to damage or injury during the handling of the bar. The other design has design features that make it expensive to manufacture.

Accordingly, it would be desirable to provide a BOP design that has quick opening features but has a locking mechanism that does not require removal of any supporting parts and is not expensive.

SUMMARY

According to one exemplary embodiment, there is a blowout preventer for sealing a well. The blowout preventer includes a body having first and second chambers, the first chamber extending substantially perpendicular to and intersecting the second chamber, the body including a channel on a face of the body; a ram block configured to move within the first chamber to seal a first region of the second chamber from a second region of the second chamber; a rod connected to the ram block and configured to extend along the first chamber; a cylinder configured to be attached to the body to border the first chamber, wherein the rod is configured to slide in and out of the cylinder; and a ring rotatably attached to the cylinder and configured to enter the channel such that the cylinder is removably attached to the body.

According to another exemplary embodiment, there is a blowout preventer for sealing a well. The blowout preventer includes a body including a circular channel on a face of the body; a ram block configured to move within a first chamber to seal a first region of a second chamber from a second region of the second chamber, the first and second chambers extending through the body and being substantially perpendicular to each other; a cylinder configured to be attached to the face of the body; a ring rotatably attached to the cylinder and configured to enter the channel such that the cylinder is removably attached to the body; plural grooves formed around the channel; and plural teeth on the ring configured to match the plural grooves. The cylinder is engaged with the body when the plural teeth enter the plural grooves as the ring is rotated a predetermined angle.

According to still another exemplary embodiment, there is a method for assembling a blowout preventer for sealing a well. The method includes providing a cylinder that includes a rod connected to a ram block; attaching the cylinder to a channel formed in a body of the blowout preventer having first and second chambers, the first chamber extending substantially perpendicular to and intersecting the second chamber, the body having the channel on a face of the body; and rotating a ring attached to the cylinder and configured to enter the channel such that the cylinder is removably attached to the body.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a ram BOP provided on top of a well head undersea. However, the embodiments to be discussed next are not limited to these systems, but may be applied to other BOPs that may be used, for example, inland.

Reference throughout the specification to "an exemplary embodiment" or "another exemplary embodiment" means that a particular feature, structure, or characteristic described in connection with an embodiment is included in at least one embodiment of the subject matter disclosed. Thus, the appearance of the phrases "in an exemplary embodiment" or "in another exemplary embodiment" in various places throughout the specification is not necessarily referring to the same embodiment. Further, the particular features, structures or characteristics may be combined in any suitable manner in one or more embodiments.

According to an exemplary embodiment, a blowout preventer (BOP) has cylinders accommodating various internal parts of the BOP and these cylinders are attached to a body of the BOP without using a screw system or hinges as is traditionally used for the bonnets. Thus, according to this embodiment, a bonnetless BOP is manufactured. One or more advantages associated with this novel BOP are discussed. It is noted that the novel BOP does not have to have all the advantages. The novel BOP may have one or more of these advantages. One advantage of a bonnetless BOP is the reduced time for reaching the ram blocks. Another advantage is the simplicity with which the cylinders are attached to a body of the BOP. Still another advantage is the low cost for manufacturing such locking mechanism between the cylinders and the body. Another advantage may be the lack of parts that are removes and stored during disassembly of the BOP.

Figure 1:
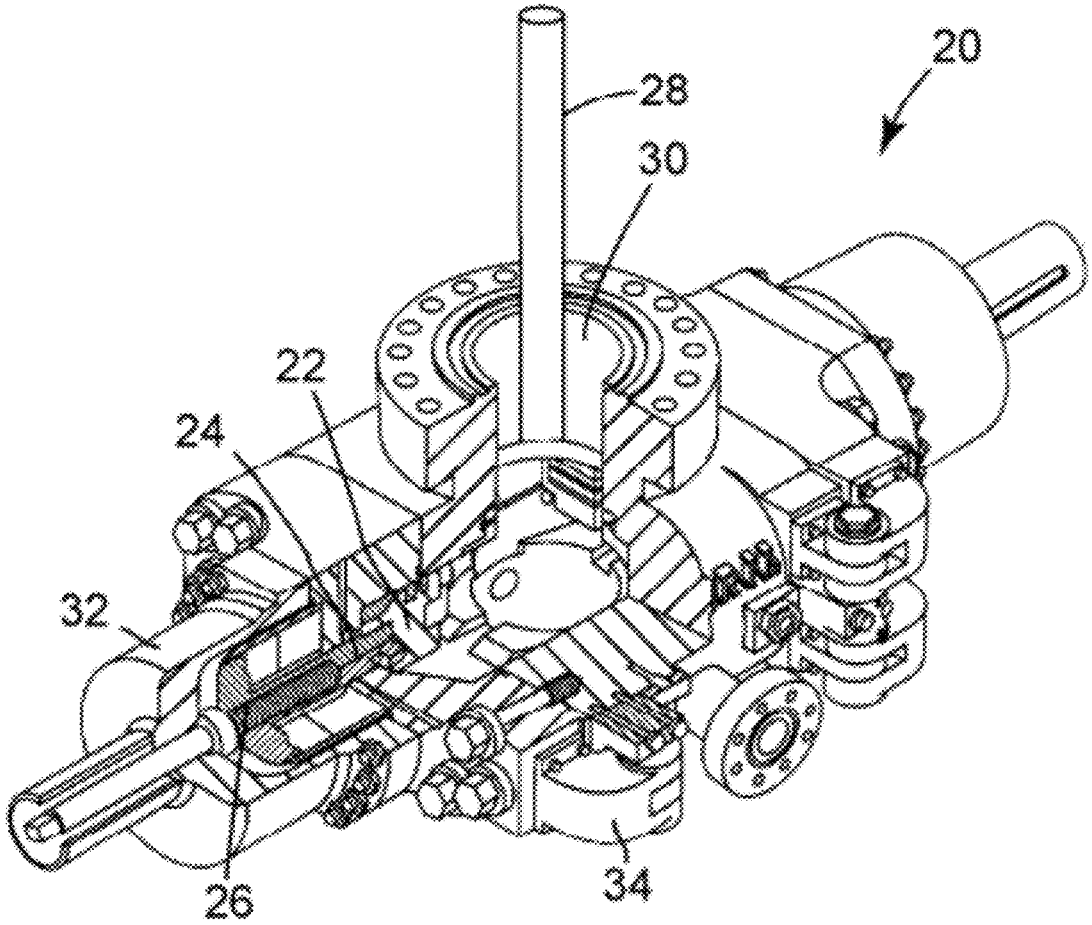
FIG. 1 Background Art
FIG. 1 is a schematic diagram of a traditional BOP.
Figure 2:
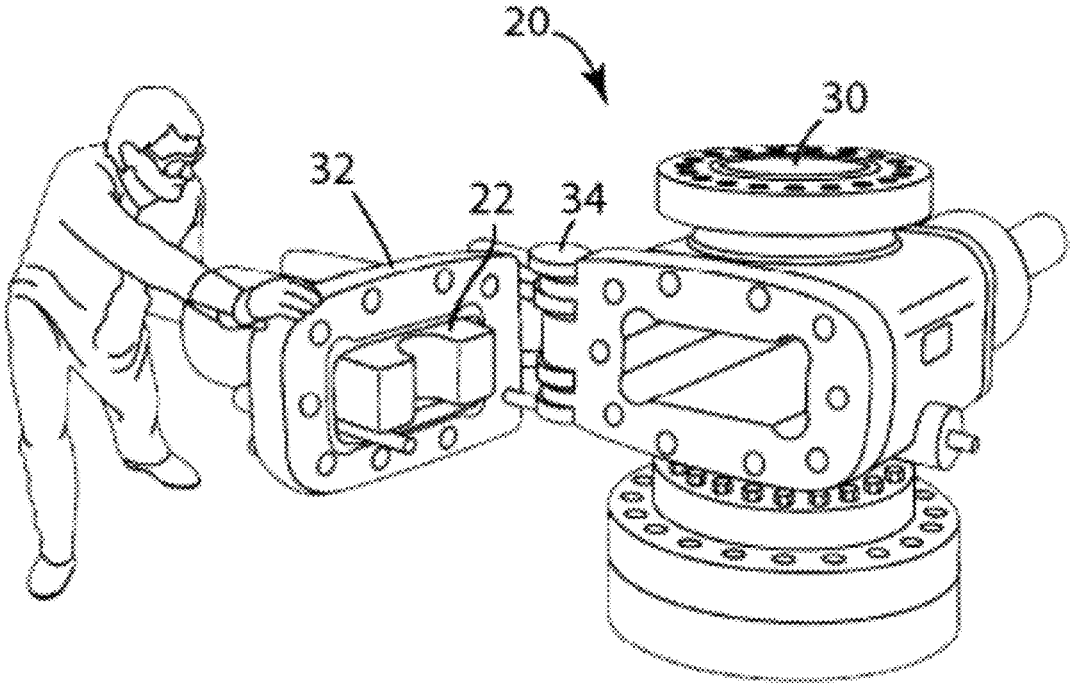
FIG. 2 Background Art
FIG. 2 is a schematic diagram of a traditional BOP in an open position.
Figure 3:
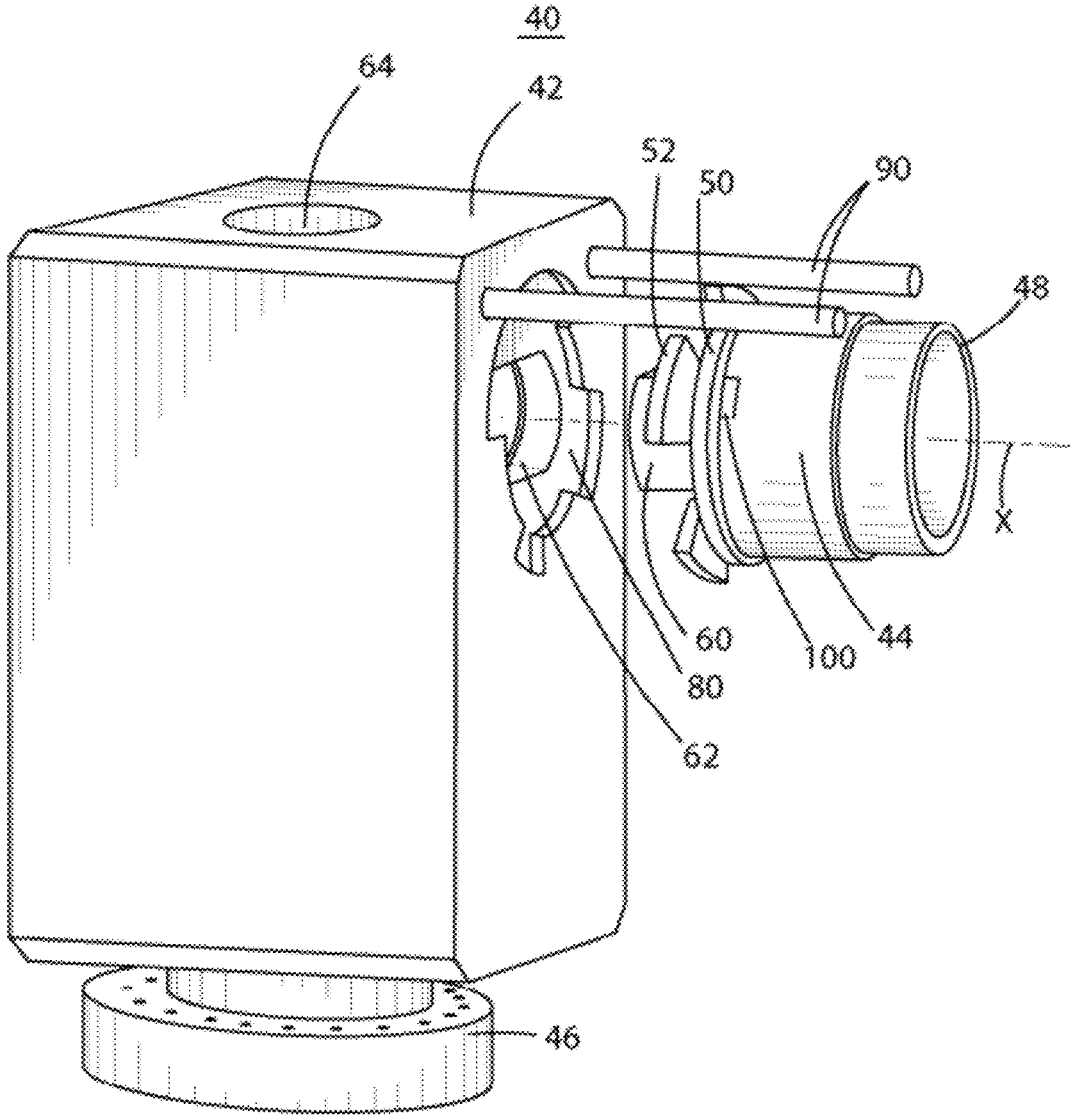
FIG. 3 is a schematic diagram of a bonetless BOP according to an exemplary embodiment.

According to an exemplary embodiment illustrated in FIG. 3, a BOP 40 system includes a body 42 and a cylinder 44 to be attached to the body 42. Cylinder 44 has a counterpart cylinder (not shown) on the other side of the body 42. Body 42 is attached to a flange 46, that is used to attach the entire BOP system 40 to a wellhead. Cylinder 44 is shown in this figure as being open at side 48. However, when assembled, a cap (not shown) closes side 48 such that a liquid inside cylinder 44 does not escape outside. Various parts of the BOP system 40 are provided inside the cylinder 44, e.g., closing chamber, opening chamber, piston separating the chambers, rod that activates the ram blocks, etc. These parts are known by those skilled in the art and also have been shown in FIG. 1. For these reasons, these parts are not shown and described here again.

Figure 4:
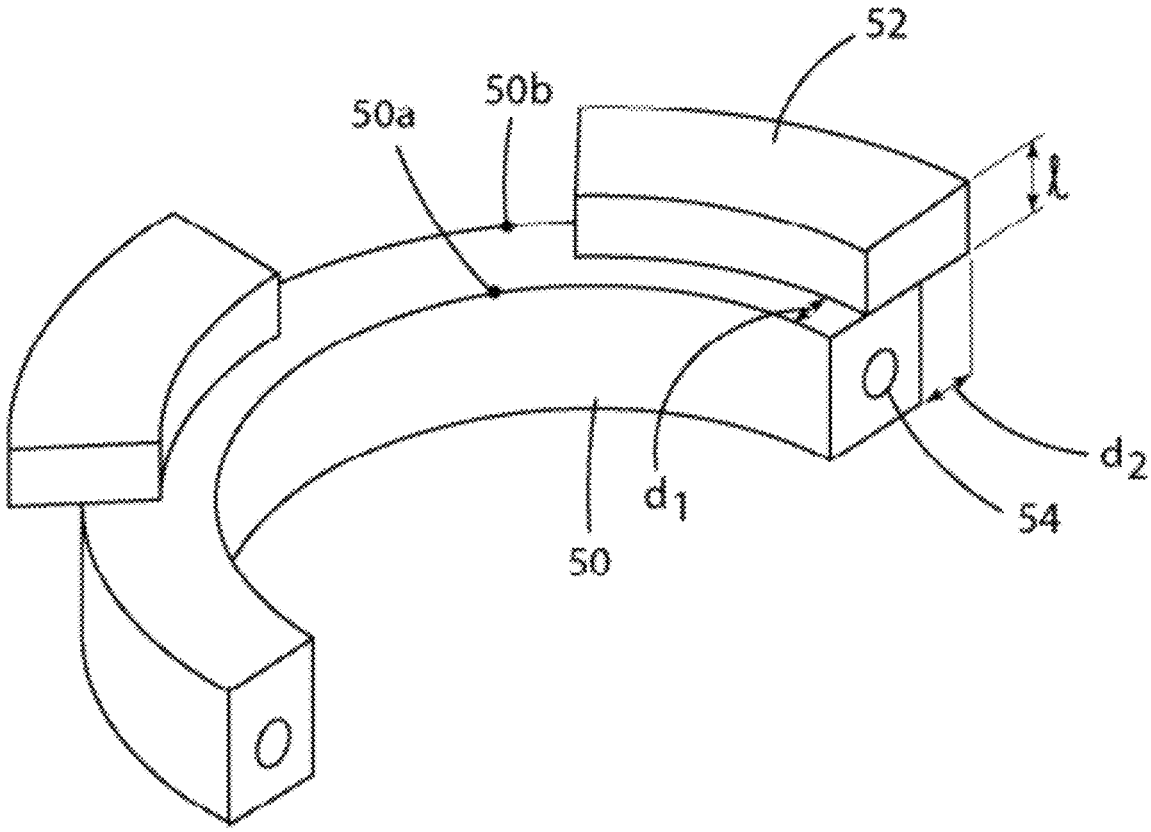
FIG. 4 is a schematic diagram of a ring that attaches to a BOP according to an exemplary embodiment.

A ring 50 may be attached to cylinder 44 so that ring 50 may rotate relative to cylinder 44. Two or more teeth 52 are attached to ring 50 as discussed later. FIG. 4 shows a more detailed view of the ring 50 and teeth 52. While FIG. 4 shows half the ring 50 and two teeth 52, there may be another number of teeth, for example, between 2 and 12, depending on the application, the diameter of the ring, the pressure inside the cylinder that the teeth has to withstand, the materials used for the body 42 and the teeth 52, etc.

Ring 50 may be manufactured as a single piece or plural pieces configured to be assembled together. In an exemplary embodiment shown in FIG. 4, the ring 50 is made of two parts that are connected together at points 54. Teeth 52 may be manufactured to be integrally formed with ring 50 or may be manufactured separately and then attached, by bolts, welding, etc., to ring 50. A shape of teeth 52 may be, as shown in FIG. 4, round, i.e., each tooth may be a section of a full ring. In one application, teeth 52 may be formed offset from a side 50*a* of ring 50, for example, by a predetermined distance d1. The teeth 52 may also extend past a side 50*b* of ring 50, for example, by a predetermined distance d2. A height h of the teeth 52 is determined based on a strength of the material making up the teeth, the pressure inside the cylinder, the pressure outside the cylinder such that a pressure difference between inside and outside does not bend the teeth and does not damage the cylinder and/or the body.

Figure 5:
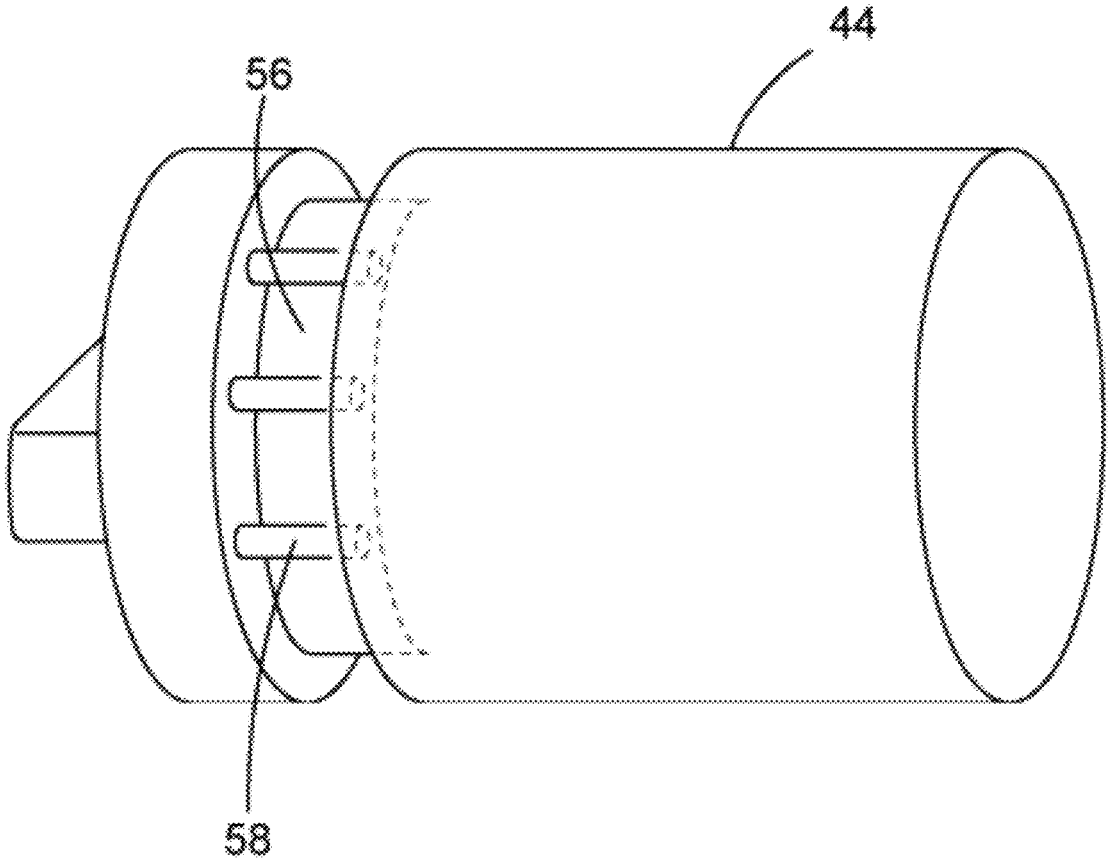
FIG. 5 is a schematic diagram of a cylinder to be attached to a BOP according to an exemplary embodiment.

According to an exemplary embodiment shown in FIG. 5, a groove 56 may be formed at one end of the cylinder 44 to accommodate the ring 50. To facilitate a rotation of the ring 50 relative to cylinder 44, a bearing system 58 may be provided inside groove 56, between groove 56 and ring 50. The bearing system 58 may include plural rolling cylinders that are configured to roll in a bearing frame (not shown) or another system may be provided as would be recognized by those skilled in the art.

Figure 6:
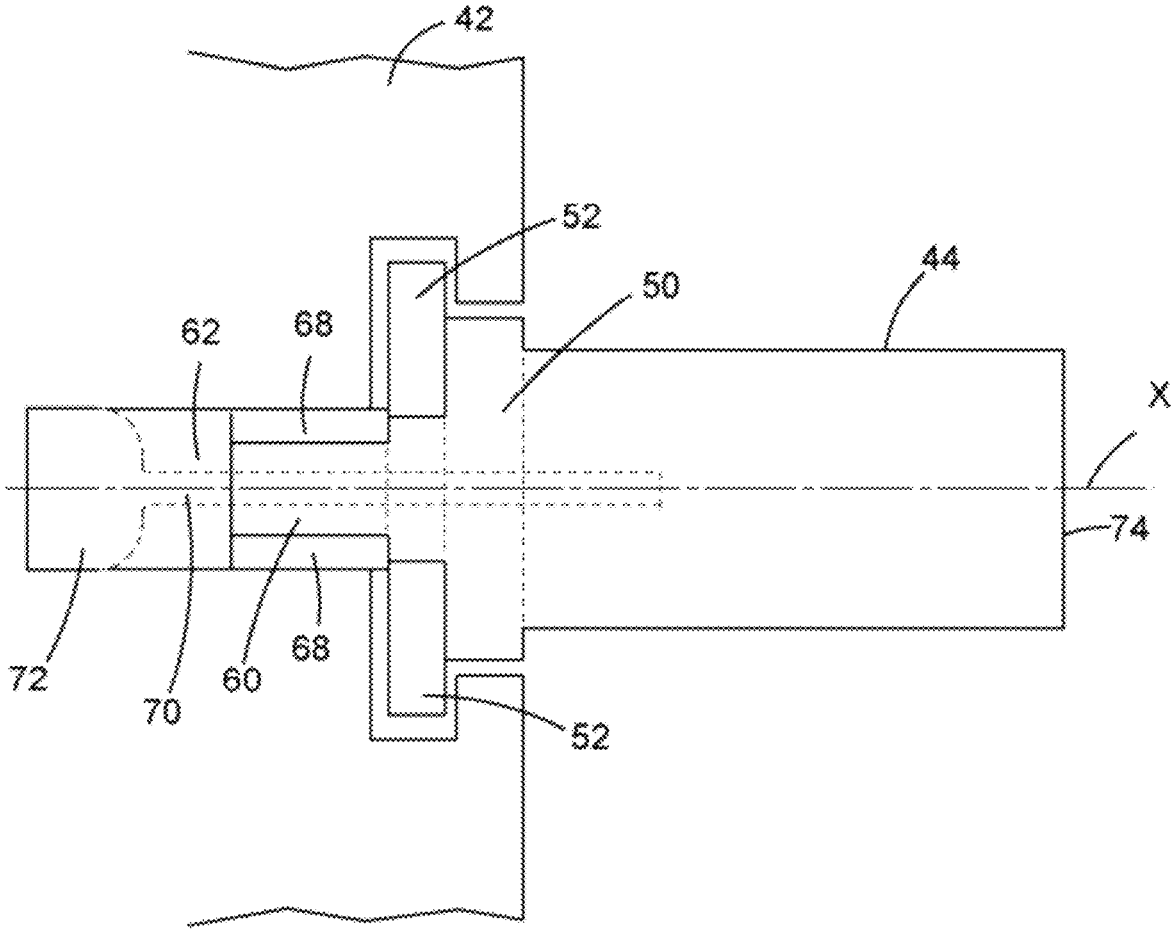
FIG. 6 is a schematic diagram of a cylinder attached to a BOP according to an exemplary embodiment.

Returning to FIG. 3, the cylinder 44 includes a seal carrier 60 that is configured to enter a first chamber 62 of the body 42. The body 42 also has a second chamber 64 that extends substantially perpendicular on the first chamber 62. The first chamber is configured to accommodate ram blocks (not shown) and the second chamber accommodates the tools (not shown) to be introduced to the well. Seal carrier 60 is configured to carry a seal 68, as shown in FIG. 6, to seal an inside of the first chamber 62 from an outside of the body 42. Thus, a working fluid under pressure that is provided in the first chamber 62 is prevented from leaking outside body 42. For completeness, a rod 70 and a ram block 72 connected to the rod 72 and a cap 74 of the cylinder 44 are also shown in FIG. 6.

Figure 7:
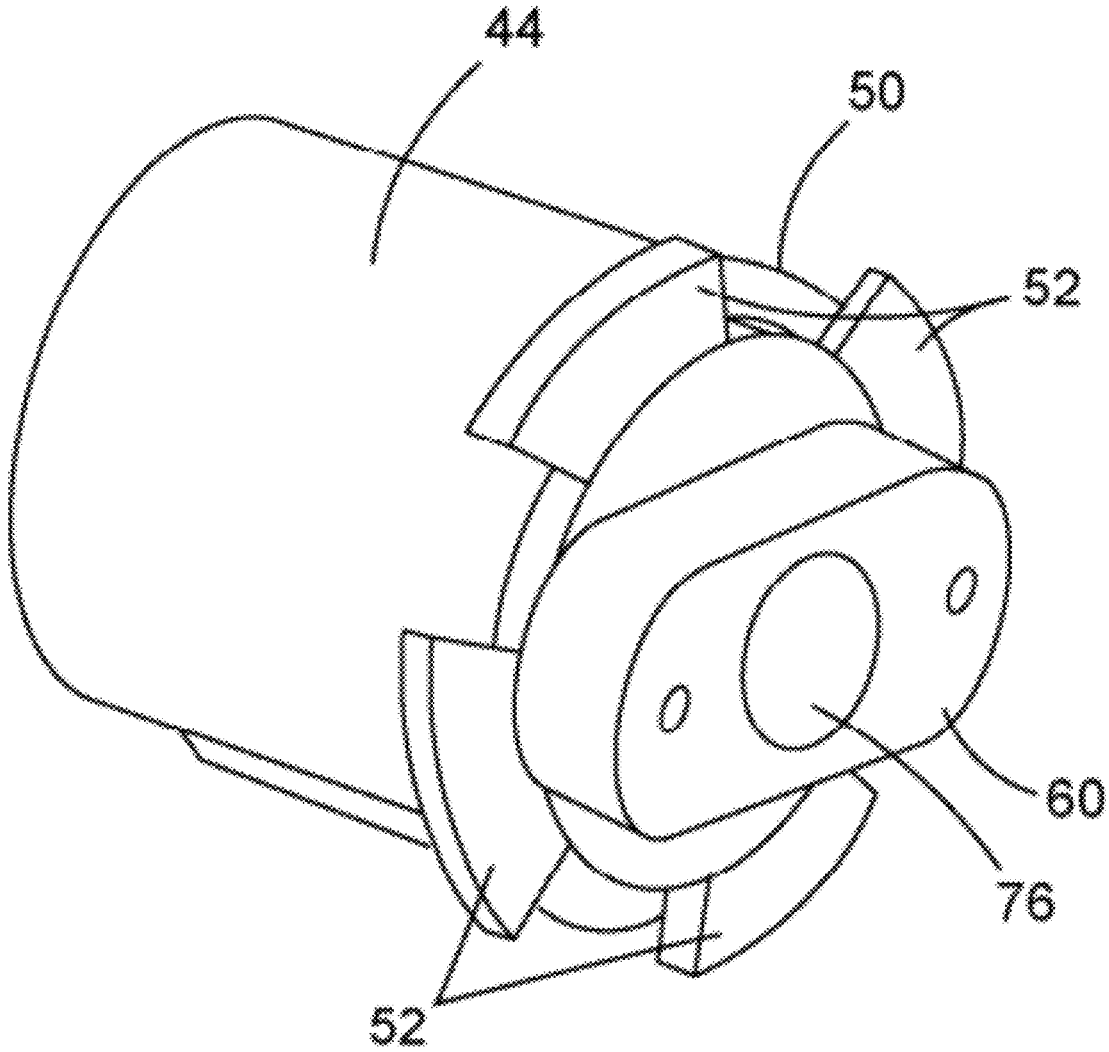
FIG. 7 is a schematic diagram of a cylinder to be attached to a BOP according to an exemplary embodiment.

Each of cylinder 44, ring 50, and seal carrier 60 has a hollow portion through which rod 70 is configured to move along axis X. A different view of the cylinder 44 and seal carrier 60 is shown in FIG. 7. In this figure, the seal carrier 60 is shown having a hole 76, through which rod 70 is configured to move. The seal carrier 60 is shown in FIG. 7 to have a specific shape, e.g., a cylinder from which two parts are cut so that the remaining part has two opposite flat faces. However, the seal carrier 60 may have other shapes as long as a corresponding hole in the body 42 matches the shape of the seal carrier 60.

Figure 9:
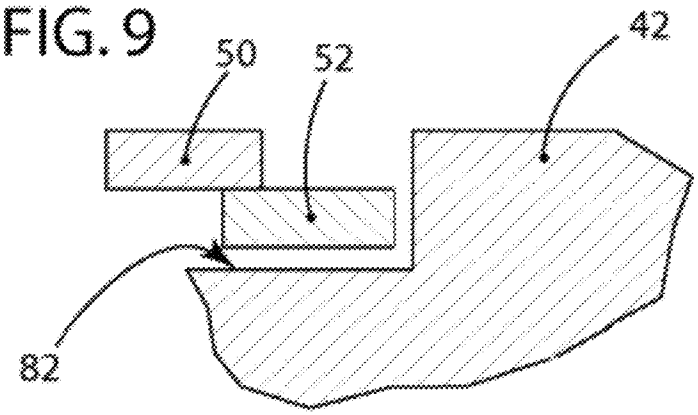
FIGS. 8-10 are detailed views of teeth of a cylinder and grooves of a body to which the cylinder is attached according to an exemplary embodiment.
Figure 10:
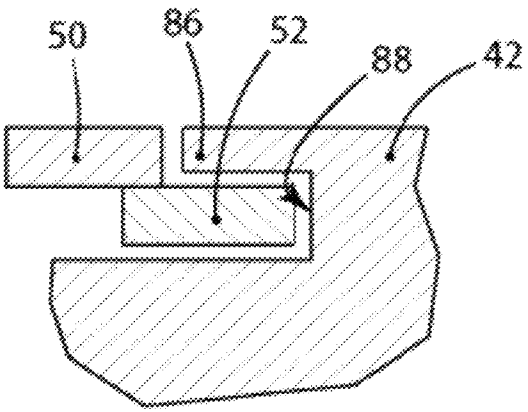
Figure 8:
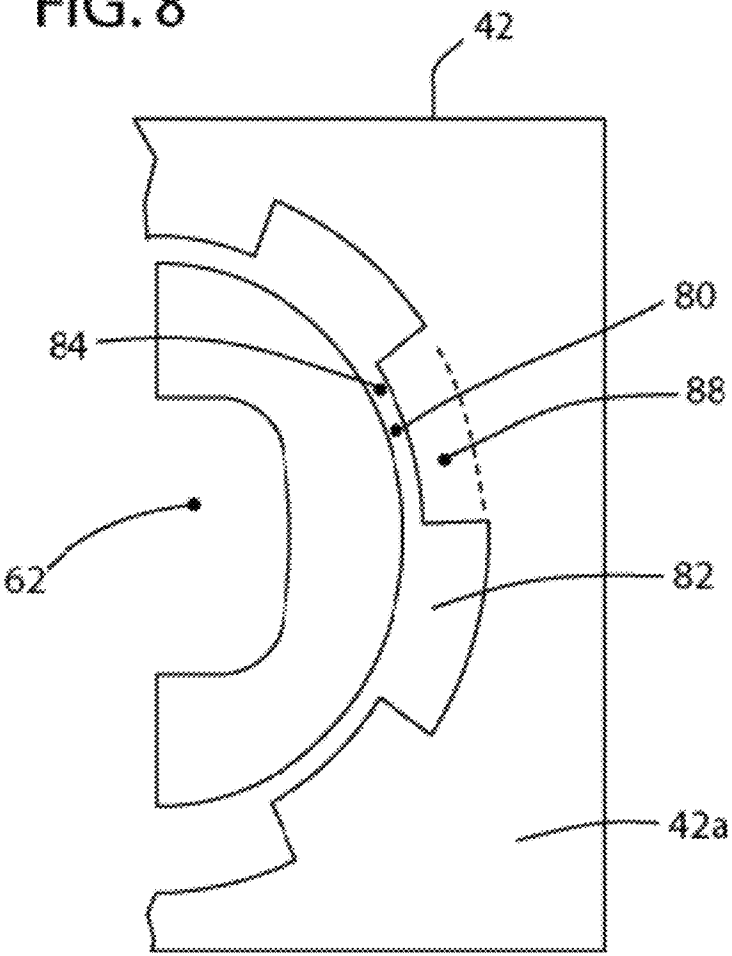

Next, corresponding channels 80 formed in the body 42 for accommodating teeth 52 are discussed with regard to FIG. 8. FIG. 8 shows a face 42*a* of the body 42 and the channels 80 formed in this face. A shape of the channel 80 is not uniform as channel 80 has to accommodate teeth 52 and ring 50. Thus, channel 80 has grooves 82 that match the shape of teeth 52 and ring receiving portions 84 that are narrower than teeth 52. Ring receiving portions 84 are configured to receive the ring 50. The reason of having a size of the ring receiving portions 84 narrower than a size of the teeth 52 is to prevent the teeth 52, after entering corresponding grooves 82 and being rotated to face portions 84, to exit channel 80, thus, maintaining the cylinder 44 attached to the body 42. The arrangement shown in FIG. 8 has each ring receiving portion 84 sandwiched between two grooves 82. FIG. 9 illustrates a tooth 52 when entering inside groove 82 of channel 80 and FIG. 10 illustrates the same tooth 52 after being rotated by a predetermined angle to align with a tunnel 88 of channel 80. Tunnels 88 are formed between adjacent grooves 82 on a circumferential direction of channel 80. Portion 86 of body 42 prevents the cylinder 44 of being detached from the body 42 when tooth 52 is engaged in channel 88. Portion 86 is designed such that it withstands the force exerted by the tooth 52 when a pressure inside chamber 62 is larger than a pressure outside body 42, i.e., a net force is pulling the cylinder 44 away from body 42.

Thus, according to an exemplary embodiment, a blowout preventer for sealing a well may include the following elements: a body having first and second chambers, the first chamber extending substantially perpendicular to the second chamber and also intersecting the second chamber, the body including a first channel on a first face of the body and a second channel on a second face of the body, the first face being opposite to the second face, first and second ram blocks configured to move within the first chamber to seal a first region of the second chamber from a second region of the second chamber; first and second rods connected to the first and second ram blocks and configured to extend along the first chamber; first and second cylinders configured to be attached to the body to border the first chamber, where the first rod is configured to slide in and out of the first cylinder and the second rod is configured to slide in an out of the second cylinder; and first and second rings attached to the first and second cylinders, respectively, and configured to enter the first and second channels such that the first and second cylinders are removably attached to the body.

The body of the blowout preventer may include plural grooves formed around the first chamber and also around each channel. Plural teeth on each ring of the blowout preventer may be configured to match the plural grooves. The plural teeth are formed on sides of the first and second rings that directly face the first and second faces of the body. In one application, the plural teeth are attached to the first and second rings. The body may include plural tunnels formed beneath the first and second faces of the body, each tunnel being configured to communicate with two adjacent grooves of the plural grooves and each tunnel extending along a circumferential direction of the first or second channels.

In one embodiment, the first and second cylinders fluidly communicate with the first chamber. In another embodiment, there are first and second locking mechanisms disposed inside the first and second cylinders and configured to lock the first and second rods at desired positions. In one application, the first and second cylinders are in direct contact with the environment as the BOP has no bonnets.

In one embodiment, two guiding rails 90 (shown in FIG. 3) may be attached to the first and second faces of the body 42 and configured to hold or slide the first and second cylinders 44 when the first and second cylinders are not engaged with the body 42. In other words, as the weight of the cylinder 44 may be in the order of hundreds of kilograms, a suspending mechanism (not shown) may be attached to the guiding rails 90 to lift the cylinder 44 to a desired height to partially fit inside the first chamber 62. The guiding rails 90 may be permanently attached to the body 42.

With regard to FIG. 3, handles 100 are shown attached to the ring 50 and these handles are used by the operator to lock in or lock out the cylinder 44 to the body 42. Alternatively or in addition, a hydraulic mechanism (not shown) may be used to lock in or lock out the ring 50.

Figure 11:
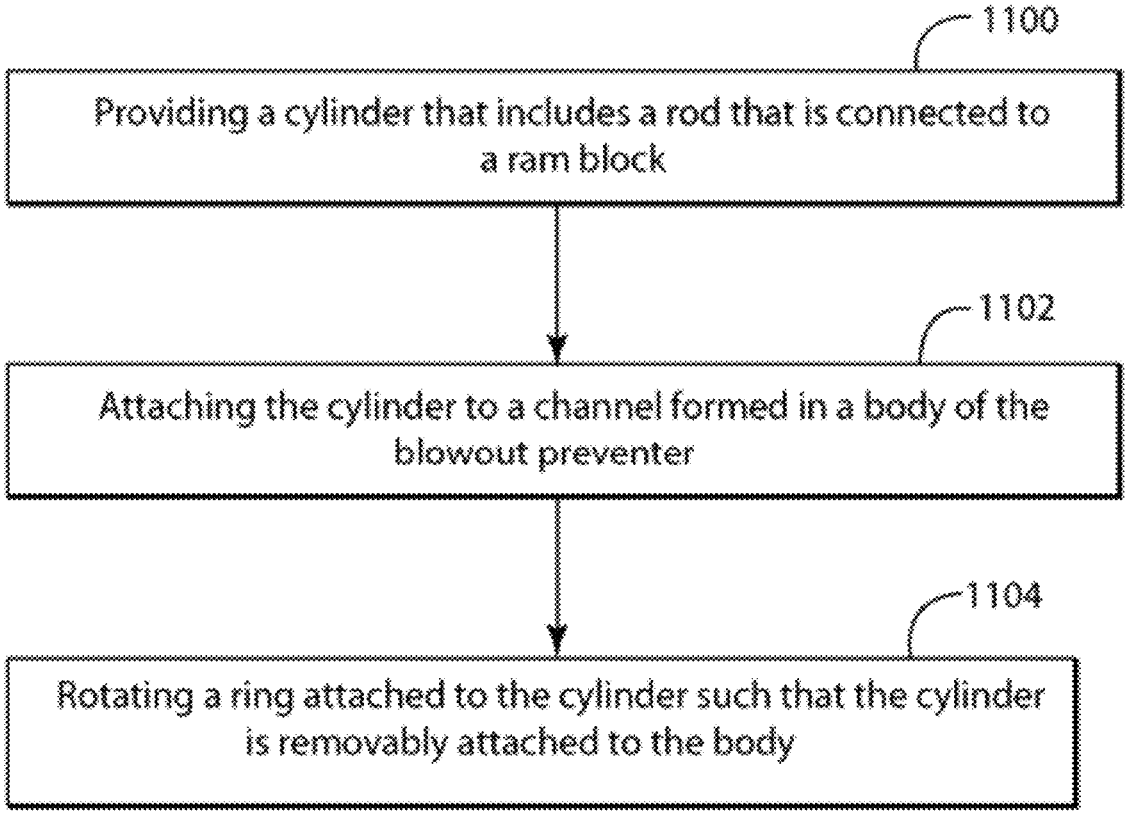
FIG. 11 is a flow chart illustrating steps of a method for attaching a cylinder to a body of a BOP according to an exemplary embodiment.

According to an exemplary embodiment illustrated in FIG. 11, there is a method for assembling a blowout preventer for sealing a well. The method includes a step 1100 of providing a cylinder that includes a rod that is connected to a ram block, a step 1102 of attaching the cylinder to a channel formed in a body of the blowout preventer having first and second chambers, the first chamber extending substantially perpendicular to and intersecting the second chamber, the body having the channel on a face of the body, and a step 1104 of rotating a ring attached to the cylinder and configured to enter the channel such that the cylinder is removably attached to the body.

The disclosed exemplary embodiments provide a BOP system and a method for attaching a cylinder to a body of the BOP without using hinges, screws, bolts or other similar mechanisms. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other example are intended to be within the scope of the claims.

What is claimed is:

1. A blowout preventer, comprising:

a body having first and second chambers, the first chamber extending substantially perpendicular to and intersecting the second chamber, the body including a channel on a face of the body;

a ram block configured to move within the first chamber to seal a first region of the second chamber from a second region of the second chamber;

a rod connected to the ram block and configured to extend along the first chamber;

a cylinder configured to be attached to the body to border the first chamber, wherein the rod is configured to slide in and out of the cylinder; and a ring rotatably attached to the cylinder and configured to enter the channel such that the cylinder is removably attached to the body.

2. The blowout preventer of claim 1, further comprising:

plural grooves formed on the body around the first chamber and also around the channel.

3. The blowout preventer of claim 2, further comprising:

plural teeth on the ring configured to match the plural grooves.

4. The blowout preventer of claim 3, wherein the plural teeth are formed on a side of the ring that directly faces the face of the body.

5. The blowout preventer of claim 3, wherein the plural teeth are attached to the ring.

6. The blowout preventer of claim 3, further comprising:

plural tunnels formed beneath the face of the body, each tunnel being configured to communicate with two adjacent grooves of the plural grooves and each tunnel extending along a circumferential direction of the channel.

7. The blowout preventer of claim 6, wherein the ring is configured to rotate relative to the cylinder such that the plural teeth move inside the tunnel securing the cylinder to the body.

8. The blowout preventer of claim 1, further comprising:

a seal carrier attached to the cylinder; and a seal attached to the seal carrier such that a fluid under pressure inside the cylinder does not escape the cylinder.

9. The blowout preventer of claim 1, wherein the cylinder fluidly communicates with the first chamber.

10. The blowout preventer of claim 1, further comprising:

a locking mechanism disposed inside the cylinder and configured to lock the rod at desired positions.

11. The blowout preventer of claim 1, wherein the cylinder is in direct contact with an outside environment of the body as there are no bonnets.

12. The blowout preventer of claim 1, wherein the cylinder includes a circumferential groove at a respective end of the cylinder.

13. The blowout preventer of claim 12, wherein the ring is configured to be provided inside the groove of the cylinder.

14. The blowout preventer of claim 12, further comprising:

bearings provided inside the groove and configured to facilitate a rotation of the ring relative to the cylinder.

15. The blowout preventer of claim 1, further comprising:

plural guiding rails attached to the face of the body and configured to hold or slide the cylinder when the cylinder is not engaged with the body.

16. The blowout preventer of claim 1, wherein the channel is circular and encircles the first chamber.

17. A blowout preventer, comprising:

a body including a circular channel on a face of the body;

a ram block configured to move within a first chamber to seal a first region of a second chamber from a second region of the second chamber, the first and second chambers extending through the body and being substantially perpendicular to each other;

a cylinder configured to be attached to the face of the body;

a ring rotatably attached to the cylinder and configured to enter the channel such that the cylinder is removably attached to the body;

plural grooves formed around the channel; and plural teeth on the ring configured to match the plural grooves, wherein the cylinder is engaged with the body when the plural teeth enter the plural grooves as the ring is rotated a predetermined angle.

18. A method for assembling a blowout preventer, the method comprising:

providing a cylinder that includes a rod that is connected to a ram block;

attaching the cylinder to a channel formed in a body of the blowout preventer having first and second chambers, the first chamber extending substantially perpendicular to and intersecting the second chamber, the body including the channel on a face of the body; and rotating a ring rotatably attached to the cylinder and configured to enter the channel such that the cylinder is removably attached to the body.

19. The method of claim 18, further comprising:

matching plural grooves formed around the first chamber and also around the channel with plural teeth on the ring.

20. The method of claim 19, further comprising:

rotating the ring so that the plural teeth enter plural tunnels formed beneath the face of the body, each tunnel being configured to communicate with two adjacent grooves of the plural grooves and the tunnel extending along a circumferential direction of the channel.

* * * * *